US005687455A

United States Patent [19]

Alexander

[11] Patent Number: 5,687,455

[45] Date of Patent: Nov. 18, 1997

[54] RELEASABLE CIRCULAR FASTENER

[76] Inventor: Gary E. Alexander, 9624 Brookline Ave., Baton Rouge, La. 70809

[21] Appl. No.: 588,444

[22] Filed: Jan. 18, 1996

[51] Int. Cl.[6] ..... B65D 63/00

[52] U.S. Cl. ..... 24/16 PB; 24/585

[58] Field of Search ..... 24/16 PB, 30.5 P, 24/16 R, 16 AP, 585, 17 A; 248/74.3

[56] References Cited

U.S. PATENT DOCUMENTS

| | | | |
|---|---|---|---|
| 3,009,220 | 2/1961 | Fein . | |
| 3,570,497 | 3/1971 | Lemole | 128/335.5 |
| 3,855,669 | 12/1974 | Meyer | 24/16 PB |
| 3,900,923 | 8/1975 | Thomas | 24/16 PB |
| 3,991,444 | 11/1976 | Bailey | 24/16 PB |
| 4,008,512 | 2/1977 | Prodel | 24/16 PB |
| 4,236,280 | 12/1980 | Kreiseder | 24/16 PB |
| 4,272,870 | 6/1981 | McCormick | 24/16 PB |
| 4,507,828 | 4/1985 | Furutsu | 24/16 PB |
| 4,727,630 | 3/1988 | Alan | 24/585 |
| 4,794,674 | 1/1989 | Mintel et al. | 24/143 R |
| 4,958,414 | 9/1990 | Benoit | 24/16 PB |
| 5,267,967 | 12/1993 | Schneider | 24/16 PB X |
| 5,293,669 | 3/1994 | Sampson | 24/16 PB |
| 5,304,188 | 4/1994 | Marogil | 24/16 PB X |
| 5,367,749 | 11/1994 | Takeuchi | 24/16 PB |
| 5,414,904 | 5/1995 | Sampson | 24/16 PB |

*Primary Examiner*—Peter M. Cuomo
*Assistant Examiner*—Stephen Vu
*Attorney, Agent, or Firm*—Roy, Kiesel & Tucker

[57] ABSTRACT

A circular loop type fastener is disclosed. It has a body made of a long flexible material that has teeth either on the top or along the sides. A buckle is located at one end. The buckle is parallel to the body of the fastener. The buckle contains channel that is appropriately sized to allow the tail end of the body to be passed through. Inside the channel is an arm with a lip that will engage the teeth of the body and prevent the body from backing up. By depressing the arm, the lip and teeth can be forced to disengage so that the body may be removed from the buckle. When the body is inserted into the buckle, a circular fastening loop is formed. The buckle will lie flat on the loop.

27 Claims, 2 Drawing Sheets

RELEASABLE CIRCULAR FASTENER

BACKGROUND OF THE INVENTION

1. Field of the Invention

This invention relates generally to fastening devices and more particularly to loops and other circular fasteners for holding loads in a cylindrical bundle.

2. Prior Art

Releasable loop type fasteners are currently commercially available. An example of such a fastener is shown in U.S. Pat. No. 4,236,280. In such fasteners, the pieces of the body member intersect each other at an angle near ninety degrees. This results in the loop having an oblong or tear drop shape, in the locking unit extending from the loop at a greater than forty-five degree angle, and in the tail end of the body member extending from the loop at a substantial angle. These are all undesirable results. The tear drop shape is not as effective a structure for distributing stress evenly across the entire structure as a circular shape. In the tear drop configuration, an expansive force from within the loop will be focused on the apex of the teardrop. Similarly, a constrictive force from outside the loop will also focus stress at the apex of the teardrop. This will lead to an increased likelihood of failure of the loop at the apex during peak stress periods. In a circular fastener, this would not be a problem, because no such focus point exists in a circle.

The fact that the locking unit in a teardrop loop extends from the loop at a greater than forty-five degree angle is also a structural deficiency. If the loop is being used to tie bundles of heavy material such as metal pipe, and those bundles are stacked, great amounts of pressure can be exerted against the locking unit as the weight of the bundles above it bends it back toward the bundle it contains. This can result in an increased likelihood of failure of the loop at the fastener. This is not a problem in a circular fastener because the locking unit can be designed to lie flat on the loop so that any force resulting from stacking will only press the locking unit against the loop and bundle rather than bending it at its point of attachment to the body member.

Finally, the teardrop configuration allows the tail end of the body member to extend from the loop at a substantial angle. When the bundle being held is of a small diameter so that the length of the tail end is long, the likelihood that the tail end will become entangled in any nearby moving parts increases. This can be avoided to some degree with a circular tie because the tail end will extend tangentially from the loop.

Another shortcoming contained in the prior art is illustrated by U.S. Pat. No. 4,958,414 to Benoit. Benoit discloses a locking mechanism which consists of a pivotable locking pawl for engaging teeth contained on the strap portion of the releasable tie. The difficulty with the apparatus disclosed in Benoit is that the pivotable locking pawl must be raised to release the strap. This can be a cumbersome task to perform when wearing gloves if the housing containing the locking mechanism is designed to lie close to the loop. As the housing is made taller, to allow for easier operation by gloved fingers, it makes even stacking of bundles more difficult, and the risk that the housing will become hung on something increases. Also, the likelihood that a stray object may become inserted in a locking mechanism such as that disclosed in Benoit increases as the size of such a locking mechanism increases. This in turn increases the likelihood that such a locking mechanism may be inadvertently released. These difficulties can be avoided by utilizing a locking mechanism that may be released by applying a downward or inward pressure. In such an apparatus, neither the dexterity of the operator nor the size of the locking mechanism required by the prior art will be necessary for the operation of the locking mechanism.

OBJECTS OF THE INVENTION

It is an object of the invention to provide a releasable circular loop type fastener.

It is another object to provide a fastener whose locking means lies flat against the loop.

It is another object to provide a fastener which may be easily opened by one wearing gloves.

It is yet another object of the invention to provide a fastener which minimizes the degree that any excess portion of the fastener extends from the fastener.

It is still another object of the invention to provide a fastener that is capable of being reused.

SUMMARY OF THE INVENTION

A circular loop type fastener is disclosed. It has a body comprised of a long flexible material that has teeth either on the top or along the sides. A buckle is located at one end. The buckle contains a channel that is the appropriate size to allow the tail end of the body to be passed through. The buckle also contains one or more arms with a lip extending from one end. The arm(s) and lip(s) are positioned so that the lip(s) will engage the teeth of the body and prevent the body from backing up. However, the teeth may be angled so that the body may move forward when the lip and teeth are engaged. Thus, the fastener may be tightened but not loosened when the teeth and lip are engaged. Each arm is mounted in the buckle so that when pressure is applied to one end, the arm will turn around a central axis. Thus, when one end is pushed down the opposite end will come up. By pushing on the end of the arm opposite the lip, one can cause the lip to disengage the teeth and allow the body of the fastener to be removed from the buckle.

DETAILED DESCRIPTION OF PREFERRED EMBODIMENTS OF THE INVENTION

Figure 4:
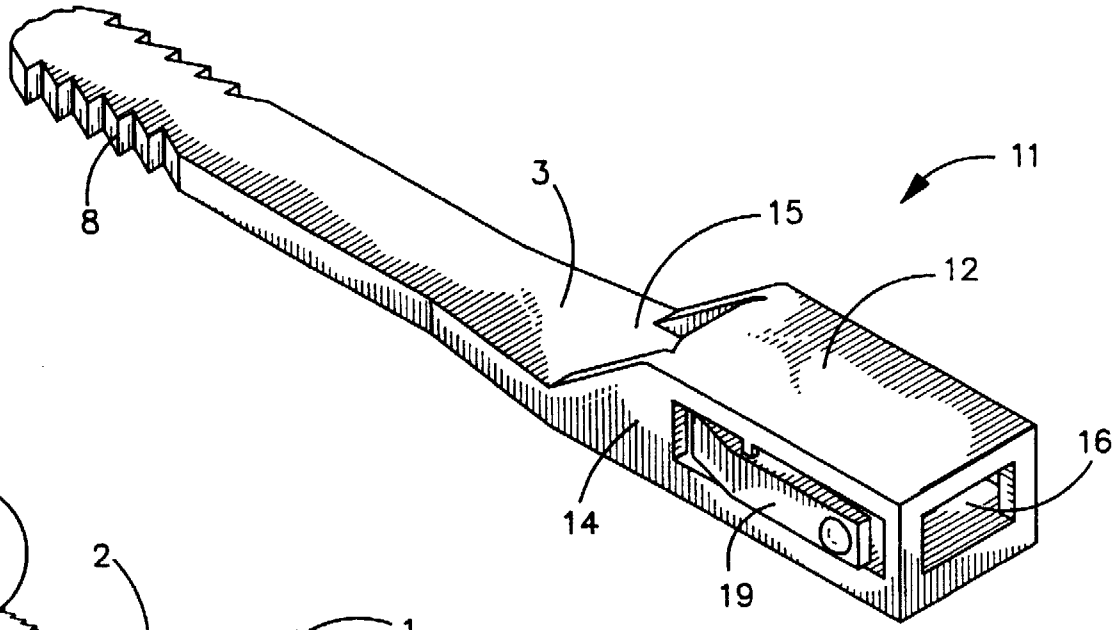
FIG. 4 is a depiction of a buckle member containing an arm in the buckle sidewalls.
Figure 1:
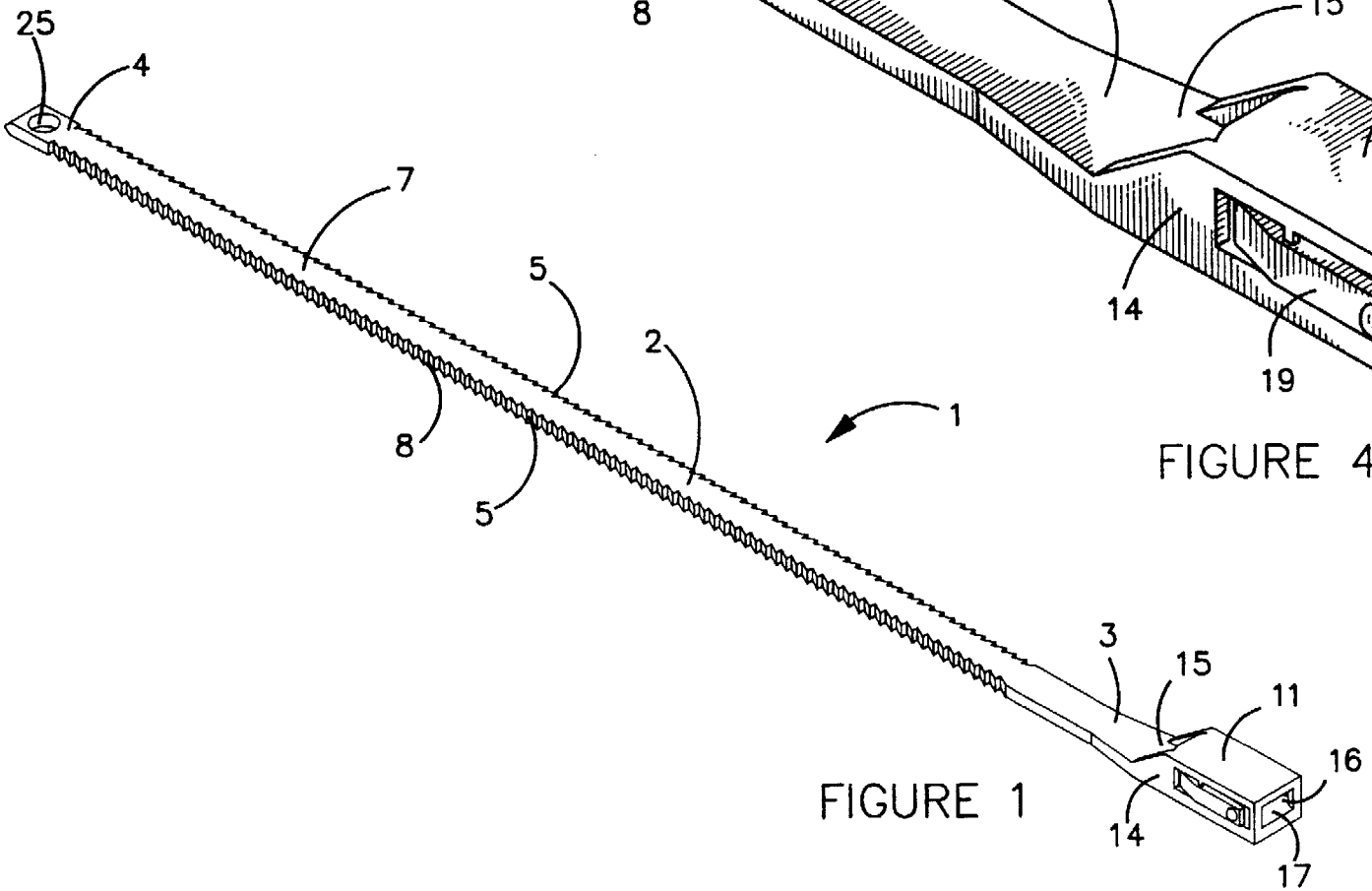
FIG. 1 is a depiction of an open releasable circular fastener wherein the arms are contained in the sidewalls of the buckle member.
Figure 5:
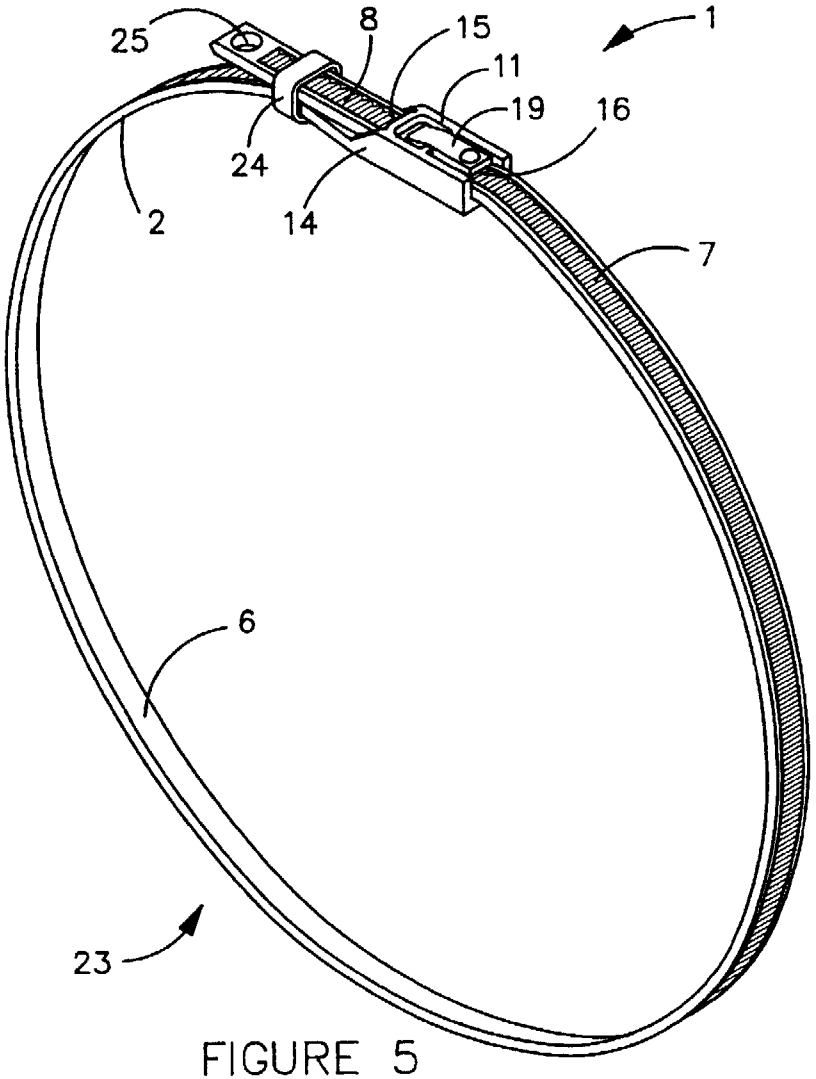
FIG. 5 is a depiction of a closed releasable circular fastener showing a buckle member containing an arm in the buckle top.
Figure 3:
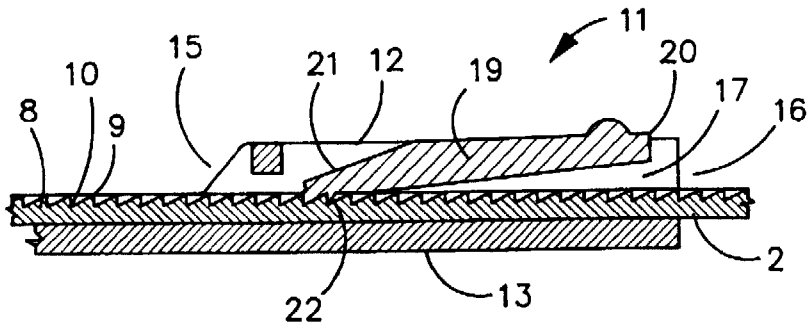
FIG. 3 is a cross sectional depiction of a buckle member with an arm in the buckle top engaging the tooth members on the body member.

As shown in the figures, the releasable circular fastener 1 comprises a body member 2 having a head end 3, a tail end 4, side body surfaces 5, lower body surface 6 and upper body surface 7. Upper body surface 7 contains a plurality of tooth members 8. In another embodiment tooth members 8 are contained on side body surfaces 5. In a preferred embodiment, tooth members 8 each have a high end 9 and a low end 10 so that tooth members 8 are angled. High end 9 of each tooth member 8 faces head end 3 and low end 10 faces tail end 4.

A buckle member 11 is attached to head end 3. Buckle member 11 has buckle sidewalls 14, a buckle top 12 and a buckle bottom 13. Buckle top 12 and buckle bottom 13 are substantially parallel to upper body surface 7 and lower body surface 6. Sidewalls 14 are substantially perpendicular to upper body surface 7 and lower body surface 6. Buckle member 11 also has open body end 15 and open free end 16. Buckle sidewalls 14, buckle top 12 and buckle bottom 13 define a buckle channel 17 to which open body end 15 and open free end 16 provide passage. Buckle channel 17 should be sized to contain body member 2. The fit between buckle channel 17 and body member 2 should be close enough to allow lip 22 to engage tooth members 8.

Figure 2:
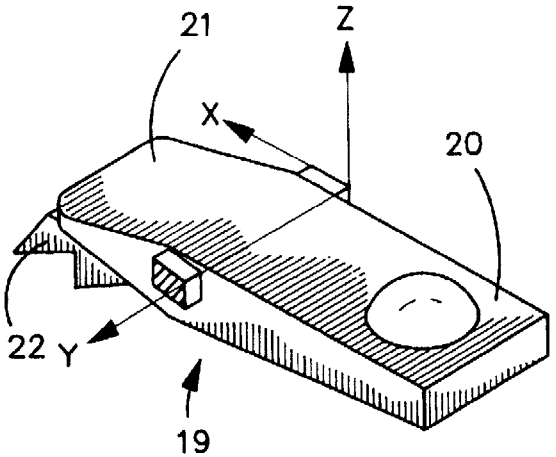
FIG. 2 is a depiction of the arm and depending lips.

An arm 19 rotable about its Y axis is pivotally mounted in buckle top 12 of buckle member 11. In a preferred embodiment arm 19 is mounted in buckle top 12 with a resilient flexible material such as plastic. One skilled in the art could mount arm 19 in buckle top 12 by any conventional means as long as arm 19 were rotable about its Y axis. In another embodiment, there are two arms 19, one pivotally mounted in each sidewall 14. In yet another embodiment, arm 19 may be mounted only in one sidewall 14. Arm 19 has a control end 20 and a lip end 21. In one preferred embodiment, lip end 21 may be wedge shaped. At least one lip 22 depends from lip end 21. As used in this application, depending refers to a general downward direction with respect to arm 19 where down refers to the negative direction on the Z axis shown in FIG. 2. In one preferred embodiment, lip 22 is substantially perpendicular to lip end 21. In an alternate preferred embodiment, lip 22 is angled away from control end 20. As shown in FIG. 2, there may be more than one such lip 22. In a more preferred embodiment, the angle of lip 22 matches the angle of tooth members 8. Arm 19 and lip 22 are adapted so that lip 22 will engage tooth members 8 of body member 2 and prevent body member 2 from retreating within buckle channel 11. In a preferred embodiment, the positioning of high end 9 and low end 10 of each tooth member 8 allows body member 2 to be moved forward when lip 22 and tooth members 8 are engaged. In this preferred embodiment, fastener 1 may be tightened but not loosened when tooth members 8 and lip 22 are engaged. By applying a downward or inward pressure to control end 20 of arm 19, lip end 21 may be raised or extended outward. This will cause lip 22 and tooth members 8 to disengage. This will allow body member 2 to be removed from buckle member 11 and consequently for fastener 1 to be opened.

Referring to the embodiment where tooth members 8 are contained in upper body member 7, for lip 22 to prevent body member 2 from retreating within buckle channel 11, the angle of tooth members 8 on the portion of body member 2 within buckle channel 11 should be at an angle of less than 90° with respect to buckle bottom 13. If the angle of tooth members 8 exceeds 90°, they will be angled in the wrong direction, which may allow body member 2 to retreat.

As loop 23 is tightened, its circumference decreases. This may cause the angle between tooth members 8 and buckle bottom 13 to increase. This can become a problem if the angle increases beyond 90°. In a preferred embodiment, tooth members 8 are angled as discussed above. This allows the angle between tooth members 8 and buckle bottom 13 to increase without compromising the locking ability of lip 22 and tooth members 8. In a more preferred embodiment, tooth members 8 are angled at 33°, which will allow for a substantial increase in the angle of tooth members 8 before the locking ability of lip 22 and tooth members 8 is compromised.

Fastener 1 is operated by inserting tail end 4 into open free end 16 of buckle member 11 and pushing body member 2 until tail end 4 extends from open body end 14. Because buckle top 12 and buckle bottom 13 are substantially parallel to upper body surface 7 and lower body surface 6, running tail end 4 of body member 2 through buckle member 11 forms a substantially circular loop 23 of which buckle member 11 is part. The diameter of loop 23 may be reduced by pulling on tail end 4 until the desired diameter is reached. If a longer fastener is needed, two or more fasteners 1 may be connected to each other by inserting a tail end 4 of one fastener 1 into buckle member 2 of a second fastener 1. The remaining unattached tail end 4 and buckle member 11 may then be connected to form a larger loop 23.

Because buckle member 11 forms part of loop 23, buckle member 11 does not extend substantially from loop 23, and the minimal extension is tangential to loop 23 so that buckle member 11 will lie flat against loop 23 when pressure is exerted against it. Because buckle member 11 is a part of loop 23, the portion of tail end 4 extending from open body end 15 will also be tangential to loop 23. This will reduce the likelihood that tail end 4 will become entangled in any apparatus that may be adjacent to fastener 1 in operation. Likelihood of entanglement may be further reduced by providing fastener 1 with a slidable ring 24 having an inside surface area at least twice the cross sectional area of body member 2. Ring 24 is positioned over body member 2 so that tail end 4 may tucked into ring 24 and secured immediately adjacent to loop 23.

In a preferred embodiment, tail end 4 may be perforated so that it contains a hole 25. A string or other object may be attached to hole 25 to prevent tail end 4 from passing through open body end 15, thereby preventing fastener 1 from opening. Hole 25 may also be used to secure tail end 4 to loop 23, thereby obviating the need for ring 24.

In another embodiment, buckle member 11 and body member 2 may comprise a releasable connector. In this embodiment, buckle member 11, rather than being attached to body member 2, will be attached to a second object that one wishes to connect to a first object. Body member 2 will be attached to the first object. In a preferred embodiment, body member 2 will be attached to the first object at head end 3. To connect the first object to the second object, body member 2 will be inserted into buckle channel 17.

It is anticipated that fastener 1 will be used to bind a wide range of items. These may include bundles of conduit or cable and wires that are being run along pipes or even the hands of arrestees by law enforcement officials. In a preferred embodiment, fastener 1, as well as connector, may be constructed of plastic, metal or rubber. Other uses and embodiments of the invention will occur to those skilled in the art, and are intended to be included within the scope and spirit of the following claims.

I claim:

1. A releasable fastener comprising:

a pliable elongated body member having a head end opposite a tail end, a lower body surface substantially parallel to an upper body surface, and a pair of substantially parallel side body surfaces, said side body surface being substantially perpendicular to said upper and lower body surfaces, said side body surfaces connecting said upper body surface to said lower body surface, said upper body surface containing a plurality of tooth members;

a buckle member attached to said head end of said body member, said buckle member having a top buckle surface substantially parallel to a bottom buckle surface, said top and bottom buckle surfaces being substantially parallel to said upper and lower body surfaces, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel substantially parallel to said body member, said buckle channel having an open body end and an open free end, said buckle channel being sized to allow said body member to pass through said open free end, said buckle channel, and said open body end; and an arm for preventing said body member from retreating within said buckle channel, said arm mounted in and substantially coplanar with said top buckle surface, said arm having an X, a Y and a Z axis, said arm having a control end and a lip end, said lip end having at least one lip depending therefrom, said lip being adapted to engage said tooth members of said body member when said body member is inserted into said buckle channel, said arm being pivotable about its Y axis, whereby said lip end and said lip may be raised by depressing said control end.

2. The releaseable fastener of claim 1 wherein said lip depends substantially perpendicularly from said lip end.

3. The releasable fastener of claim 1 wherein said lip depends at an angle, said angle being directed away from said control end.

4. The releasable fastener of claim 1 wherein said tooth members have a high end facing said head end of said body member and a low end facing said tail end of said body member.

5. The releasable fastener of claim 1 wherein said tail end of said body member is perforated.

6. A releasable fastener comprising:

a pliable elongated body member having a head end opposite a tail end, a lower body surface substantially parallel to an upper body surface, and a pair of substantially parallel side body surfaces, said side body surfaces being substantially perpendicular to said upper and lower body surfaces, said side body surfaces connecting said upper body surface to said lower body surface, at least one of said side body surfaces containing a plurality of tooth members;

a buckle member attached to said head end of said body member, said buckle member having a top buckle surface substantially parallel to a bottom buckle surface, said top and bottom buckle surfaces being substantially parallel to said upper and lower body surfaces, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel substantially parallel to said body member, said buckle channel having an open body end and an open free end, said buckle channel being sized to allow said body member to pass through said open free end, said buckle channel, and said open body end; and an arm for preventing said body member from retreating within said buckle channel, said arm mounted in and substantially coplanar with the one of said sidewalls corresponding to said side body surface containing said plurality of tooth members, said arm having an X, a Y and a Z axis, said arm having a control end and a lip end, said lip end having at least one lip depending therefrom, said lip being adapted to engage said tooth members of said body member when said body member is inserted into said buckle channel, said arm being pivotable about its Y axis, whereby said lip end and said lip may be outwardly extended by exerting an inward pressure on said control end.

7. The releasable fastener of claim 6 wherein said lip depends substantially perpendicularly from said lip end.

8. The releasable fastener of claim 6 wherein said lip depends at an angle, said angle being directed away from said control end.

9. The releasable fastener of claim 6 wherein said tooth members are angled toward said head end of said body member.

10. The releasable fastener of claim 6 wherein the tail end of said body member is perforated.

11. A releasable fastener comprising:

a pliable elongated body member having a head end opposite a rail end, a lower body surface substantially parallel to an upper body surface, and a pair of substantially parallel side body surfaces, said side body surfaces being substantially perpendicular to said upper and lower body surfaces, said side body surfaces connecting said upper body surface to said lower body surface, at least one of said side body surfaces containing a plurality of tooth members;

a buckle member attached to said head end of said body member, said buckle member having a top buckle surface substantially parallel to a bottom buckle surface, said top and bottom buckle surfaces being substantially parallel to said upper and lower body surfaces, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel substantially parallel to said body member, said buckle channel having an open body end and an open free end, said buckle channel being sized to allow said body member to pass through said open free end, said buckle channel, and said open body end; and an arm for preventing said body member from retreating within said buckle channel mounted in and substantially coplanar with each of said sidewalls, each said arm having an X, a Y and a Z axis, each said arm having a control end and a lip end, each said lip end having at least one lip depending therefrom, each said lip being adapted to engage said tooth members of said body member when said body member is inserted into said buckle channel, each said arm being pivotable about its Y axis, whereby each said lip end and each said lip may be outwardly extended by exerting an inward pressure on each said control end.

12. The releasable fastener of claim 11 wherein each said lip depends substantially perpendicularly from each said lip end.

13. The releasable fastener of claim 11 wherein each said lip depends at an angle, each said angle being directed away from each said control end.

14. The releasable fastener of claim 11 wherein said tooth members are angled toward said head end of said body member.

15. The releasable fastener of claim 11 wherein the tail end of said body member is perforated.

16. A releasable connector for connecting a first object to a second object comprising:

a body member adapted to attach to said first object, said body member having a head end opposite a tail end, a lower body surface substantially parallel to an upper body surface, and a pair of substantially parallel side body surfaces, said side body surfaces being substantially perpendicular to said upper and lower body surfaces, said side body surfaces connecting said upper body surface to said lower body surface, said upper body surface containing a plurality of tooth members;

a buckle member adapted to attach to said second object, said buckle member having a top buckle surface substantially parallel to a bottom buckle surface, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel, said buckle channel having an open body end and an open free end, said buckle channel being sized to allow said body member to pass through said open free end, said buckle channel, and said open body end; and an arm for preventing said body member from retreating within said buckle channel, said arm mounted in and substantially coplanar with said top buckle surface, said arm having an X, a Y and a Z axis, said arm having a control end and a lip end, said lip end having at least one lip depending therefrom, said lip being adapted to engage said tooth members of said body member when said body member is inserted into said buckle channel, said arm being pivotable about its Y axis, whereby said lip end and said lip may be raised by depressing said control end.

17. The releasable fastener of claim 15 wherein said lip depends substantially perpendicularly from said lip end.

18. The releasable fastener of claim 15 wherein said lip depends at an angle, said angle being directed away from said control end.

19. The releasable fastener of claim 16 wherein said tooth members have a high end facing said head end of said body member and a low end facing said tail end of said body member.

20. A releasable connector for connecting a first object to a second object comprising:

a body member adapted to attach to said first object, said body member having a head end opposite a tail end, a lower body surface substantially parallel to an upper body surface, and a pair of substantially parallel side body surfaces, said side body surfaces being substantially perpendicular to said upper and lower body surfaces, said side body surfaces connecting said upper body surface to said lower body surface, at least one of said side body surfaces containing a plurality of tooth members;

a buckle member adapted to attach to said second object, said buckle member having a top buckle surface substantially parallel to a bottom buckle surface, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel substantially parallel to said body member, said buckle channel having an open body end and an open free end, said buckle channel being sized to allow said body member to pass through said open free end, said buckle channel, and said open body end; and an arm for preventing said body member from retreating within said buckle channel, said arm mounted in and substantially coplanar with the one of said sidewalls corresponding to said side body surface containing said plurality of tooth members, said arm having an X, a Y and a Z axis, said arm having a control end and a lip end, said lip end having at least one lip depending therefrom, said lip being adapted to engage said tooth members of said body member when said body member is inserted into said buckle channel, said arm being pivotable about its Y axis, whereby said lip end and said lip may be outwardly extended by exerting an inward pressure on said control end.

21. The releasable fastener of claim 20 wherein said lip depends substantially perpendicularly from said lip end.

22. The releasable fastener of claim 20 wherein said lip depends at an angle, said angle being directed away from said control end.

23. The releasable fastener of claim 20 wherein said tooth members are angled toward said head end of said body member.

24. A releasable connector for connecting a first object to a second object comprising:

a body member adapted to attach to said first object, said body member having a head end opposite a tail end, a lower body surface substantially parallel to an upper body surface, and a pair of substantially parallel side body surfaces, said side body surfaces being substantially perpendicular to said upper and lower body surfaces, said side body surfaces connecting said upper body surface to said lower body surface, at least one of said side body surfaces containing a plurality of tooth members;

a buckle member adapted to attach to said second object, said buckle member having a top buckle surface substantially parallel to a bottom buckle surface, said buckle member also having a pair of substantially parallel sidewalls, said sidewalls being substantially perpendicular to said top and bottom buckle surfaces, said sidewalls connecting said top buckle surface to said bottom buckle surface, said top buckle surface, said bottom buckle surface, and said sidewalls being positioned to define a buckle channel substantially parallel to said body member, said buckle channel having an open body end and an open free end, said buckle channel being sized to allow said body member to pass through said open free end, said buckle channel, and said open body end; and an arm for preventing said body member from retreating within said buckle channel mounted in and substantially coplanar with each of said sidewalls, each said arm having an X, a Y and a Z axis, each said arm having a control end and a lip end, each said lip end having at least one lip depending therefrom, each said lip being adapted to engage said tooth members of said body member when said body member is inserted into said buckle channel, each said arm being pivotable about its Y axis, whereby each said lip end and each said lip may be outwardly extended by exerting an inward pressure on each said control end.

25. The apparatus of claim 24 wherein each said lip depends substantially perpendicularly from each said lip end.

26. The releasable fastener of claim 24 wherein each said lip depends at an angle, each said angle being directed away from each said control end.

27. The releasable fastener of claim 24 wherein said tooth members are angled toward said head end of said body member.

* * * * *